US009843135B2

(12) United States Patent
Guetig et al.

(10) Patent No.: US 9,843,135 B2
(45) Date of Patent: Dec. 12, 2017

(54) CONFIGURABLE, HIGH-BANDWIDTH CONNECTOR

(71) Applicant: Samtec, Inc., New Albany, IN (US)

(72) Inventors: Keith R. Guetig, New Albany, IN (US); John R. Cummings, New Albany, IN (US); Stephen P. Koopman, New Albany, IN (US)

(73) Assignee: SAMTEC, INC., New Albany, IN (US)

( * ) Notice: Subject to any disclaimer, the term of this patent is extended or adjusted under 35 U.S.C. 154(b) by 0 days.

(21) Appl. No.: 15/223,353

(22) Filed: Jul. 29, 2016

(65) Prior Publication Data

US 2017/0194744 A1 Jul. 6, 2017

Related U.S. Application Data

(60) Provisional application No. 62/199,866, filed on Jul. 31, 2015.

(51) Int. Cl.

| | |
|---|---|
| ***H01R 12/00*** | (2006.01) |
| ***H01R 13/6474*** | (2011.01) |
| ***H01R 12/75*** | (2011.01) |
| ***H01R 13/66*** | (2006.01) |
| ***H01R 13/648*** | (2006.01) |
| ***H01R 24/50*** | (2011.01) |
| *H01R 103/00* | (2006.01) |

(52) U.S. Cl.
CPC ..... *H01R 13/6474* (2013.01); *H01R 12/75* (2013.01); *H01R 13/648* (2013.01); *H01R 13/665* (2013.01); *H01R 24/50* (2013.01); *H01R 2103/00* (2013.01)

(58) Field of Classification Search
CPC .. H01R 13/6474; H01R 13/514; H01R 13/11; H01R 13/506; H01R 12/75; H01R 12/724; H01R 13/648; H01R 24/50; H01R 13/665; H01R 2103/00; H01R 9/0512; H01R 24/44; H01R 23/688
USPC ..... 439/63
See application file for complete search history.

(56) References Cited

U.S. PATENT DOCUMENTS

| | | | |
|---|---|---|---|
| 3,910,665 | A | 10/1975 | Stull |
| 4,087,146 | A | 5/1978 | Hudson, Jr. |
| 4,420,794 | A | 12/1983 | Anderson |

(Continued)

FOREIGN PATENT DOCUMENTS

KR 10-2010-0090774 A 8/2010

OTHER PUBLICATIONS

TE connectivity, "Mid Board Optical Transceiver; Featuring Coolbit Optical Engines 12×25.78125 Gbps", Data Communications, 2014, pp. 1-6.

(Continued)

*Primary Examiner* — Jean F Duverne
(74) *Attorney, Agent, or Firm* — Keating & Bennett, LLP

(57) ABSTRACT

A connector mountable to a main printed circuit board (PCB) includes at least one carrier, at least one cable mounted to the at least one carrier, and an interposer that routes signals and ground connections between the at least one cable and the main PCB when the connector is mounted to the main PCB. The at least one cable is vertically mounted in the connector such that the at least one cable is perpendicular or substantially perpendicular to a mounting surface of the main PCB.

24 Claims, 13 Drawing Sheets

(56) References Cited

U.S. PATENT DOCUMENTS

| | | | | |
|---|---|---|---|---|
| 4,941,831 | A * | 7/1990 | Tengler | H01R 24/44 439/579 |
| 4,948,379 | A | 8/1990 | Evans | |
| 4,955,814 | A | 9/1990 | Christie et al. | |
| 5,190,472 | A | 3/1993 | Voltz et al. | |
| 5,194,020 | A | 3/1993 | Voltz | |
| 5,358,417 | A | 10/1994 | Schmedding | |
| 5,386,344 | A | 1/1995 | Beaman et al. | |
| 5,475,317 | A | 12/1995 | Smith | |
| 5,920,459 | A | 7/1999 | Weber et al. | |
| 6,592,401 | B1 | 7/2003 | Gardner et al. | |
| 6,783,371 | B2 | 8/2004 | Self et al. | |
| 6,786,762 | B2 | 9/2004 | Buck et al. | |
| 7,445,471 | B1 * | 11/2008 | Scherer | H01R 13/506 439/108 |
| 7,553,187 | B2 * | 6/2009 | Feldman | H01R 13/11 439/108 |
| 7,909,646 | B2 * | 3/2011 | Feldman | H01R 9/0512 439/108 |
| 7,927,144 | B2 * | 4/2011 | Feldman | H01R 13/514 439/607.05 |
| 7,997,933 | B2 * | 8/2011 | Feldman | H01R 23/688 439/108 |
| 8,152,562 | B2 | 4/2012 | Gross | |
| 8,187,035 | B2 * | 5/2012 | Davis | H01R 12/724 439/607.02 |
| 8,632,263 | B2 | 1/2014 | Nekado et al. | |
| 9,011,177 | B2 | 4/2015 | Lloyd et al. | |
| 9,362,638 | B2 * | 6/2016 | Ljubijankic | H01R 43/16 |
| 2009/0104809 | A1 | 4/2009 | Feldman et al. | |
| 2012/0052744 | A1 | 3/2012 | Straka et al. | |
| 2012/0058684 | A1 | 3/2012 | De Geest et al. | |

OTHER PUBLICATIONS

Official Communication issued in corresponding International Application PCT/US2016/044724, dated Nov. 8, 2016.

* cited by examiner

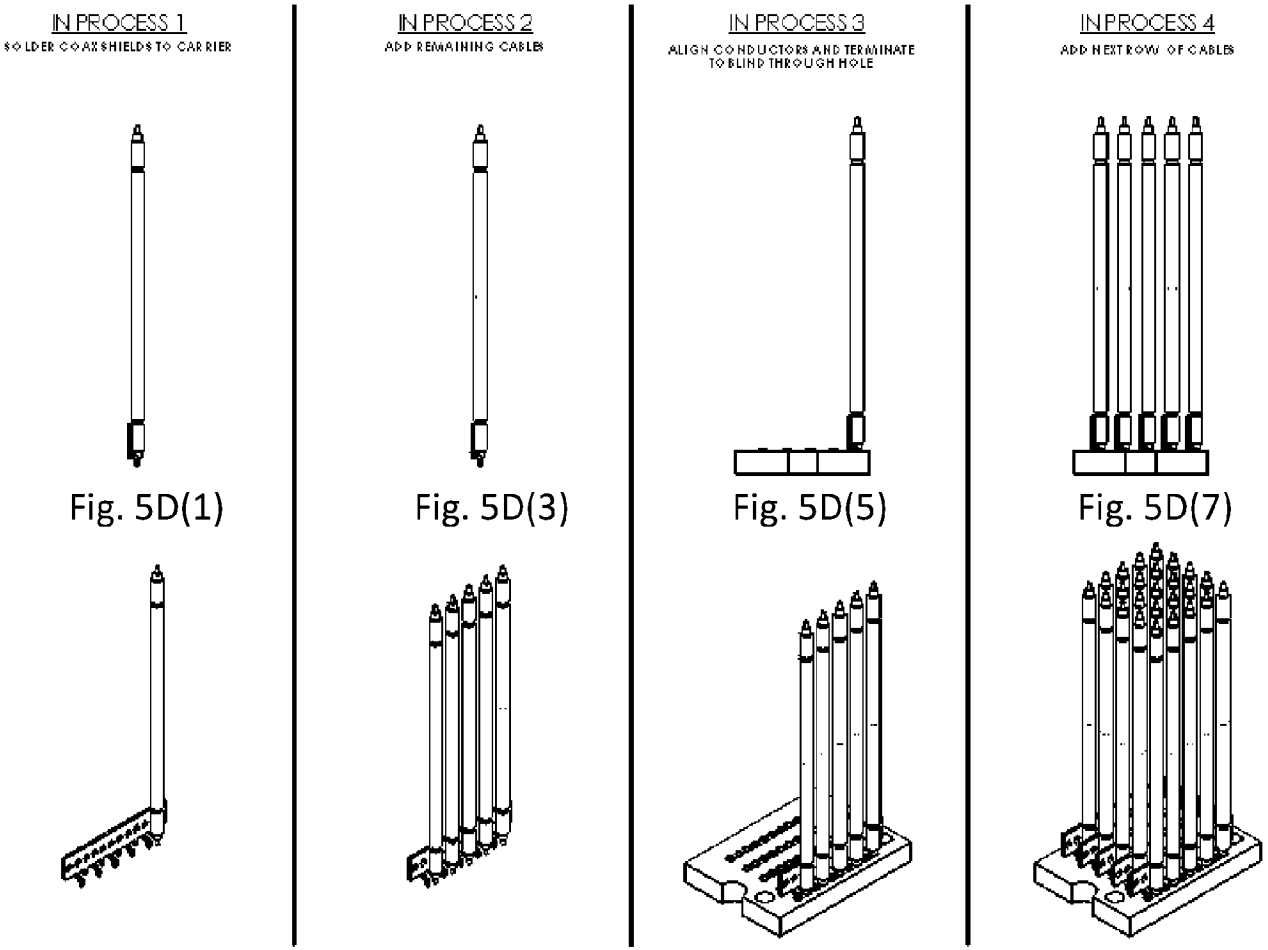
Fig. 5D(1)
Fig. 5D(2)
Fig. 5D(3)
Fig. 5D(4)
Fig. 5D(5)
Fig. 5D(6)
Fig. 5D(7)
Fig. 5D(8)

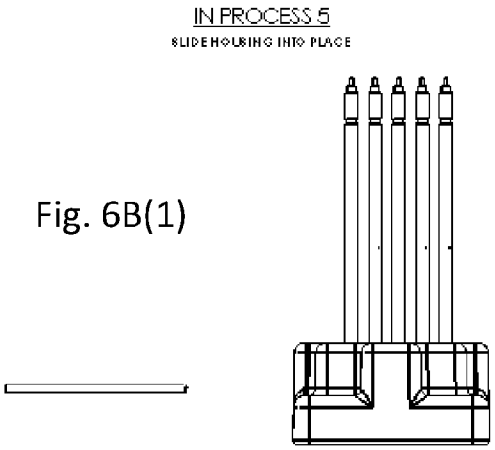
Fig. 6B(1)
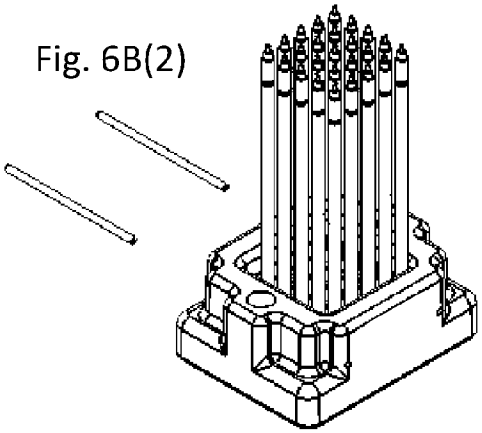
Fig. 6B(2)
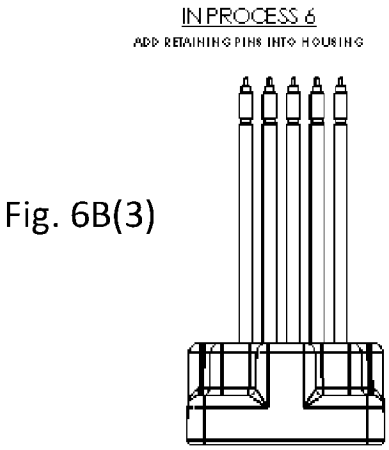
Fig. 6B(3)
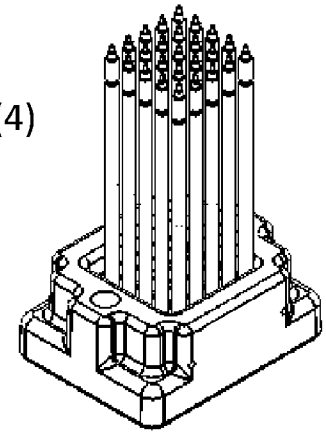
Fig. 6B(4)

CONFIGURABLE, HIGH-BANDWIDTH CONNECTOR

BACKGROUND OF THE INVENTION

1. Field of the Invention

The present invention relates to electrical connectors. More specifically, the present invention relates to high-bandwidth connectors with multiple parallel connections.

2. Description of the Related Art

Electrical connectors are used to place electrical devices in communication with one another, for example, to connect an electrical device or cable to a printed circuit board (PCB). A typical connector includes one or more contacts that electrically and mechanically connect the connector to one or more corresponding pads of a circuit board. The electrical and mechanical connection between a contact and a pad is typically provided by a fusible material, such as solder.

Although a cable typically provides a signal path with high signal integrity (for example, a shielded cable such as a coaxial cable or twinaxial cable), an electrical path through a connector that attaches the cable to a PCB usually provides a signal path with lower signal integrity, especially at higher frequencies. Such electrical paths through connectors often have much higher loss than a shielded cable and are far more susceptible to interference and cross-talk. That is, known connectors have a limited ability to propagate high-bandwidth signals without loss or back reflections.

In addition, known connectors are generally inflexible regarding the number, type, and diameter of cables that can be used. Known electrical connectors are also typically designed to be tuned to a specific impedance. Accordingly, if different connector types and/or impedance profiles are needed for electrical device(s) mounted on a PCB, a different electrical connector is required for each particular impedance profile of the electrical device so that each electrical connector can perform optimally at the necessary impedance profile of the electrical device. Thus, according to conventional approaches, many different electrical connectors must be purchased or manufactured for electrical devices that require different electrical profiles, which results in significant material and labor costs.

Many known connectors use "horizontal mounting" in which cables and connectors are oriented parallel or substantially parallel to the major planar surfaces of a main mounting surface or PCB. Horizontal mounting requires that the connector be connected at an edge of the main mounting surface or PCB, which provides less nearby mounting space for electronic components. Thus, known horizontal connectors tend to increase the path length of signals not transmitted through a cable and require different housings for connectors with different numbers of contacts.

SUMMARY OF THE INVENTION

To overcome the problems described above, preferred embodiments of the present invention provide a configurable, high-bandwidth connector that supports different contact pitches, different numbers of cables, and different cable diameters. Further, the preferred embodiments of the present invention significantly reduce or minimize the length of a path along which a signal is not transmitted through a cable, which supports high-bandwidth operation of the connector.

A connector mountable to a main printed circuit board (PCB) according to a preferred embodiment of the present invention includes at least one carrier, at least one cable mounted to the at least one carrier, and an interposer that routes signals and ground connections between the at least one cable and the main PCB when the connector is mounted to the main PCB. The at least one cable is vertically mounted in the connector such that the at least one cable is perpendicular or substantially perpendicular to a mounting surface of the main PCB.

The at least one cable is preferably soldered to the at least one carrier. The at least one cable is preferably a coaxial cable, a twinaxial cable, or a discrete, unshielded wire. Preferably, the at least one cable includes a plurality of cables mounted to a first carrier of the at least one carrier. Preferably, the at least one cable includes a first cable mounted to a first carrier of the at least one carrier and includes a second cable mounted to a second carrier of the at least one carrier, and the first cable and the second cable include different size center conductors or different characteristic impedances.

The connector preferably further includes an intermediate PCB arranged between the at least one carrier and the interposer. A signal path of the at least one cable is preferably connected to a signal path of the intermediate PCB. The at least one carrier is preferably electrically connected to a ground path via or a ground region of the intermediate PCB.

A ground path or ground shield of the at least one cable is preferably connected to the at least one carrier. The at least one carrier preferably includes prongs that are aligned with a signal conductor of the at least one cable along a length of the at least one carrier such that the prongs of the at least one carrier and the signal conductor of the at least one cable define a single row. The at least one carrier preferably includes tabs that are offset from a signal conductor of the at least one cable.

The interposer preferably includes at least one guide hole arranged to mate with at least one alignment pin of the main PCB to align at least one contact of the interposer with at least one contact of the main PCB. The interposer preferably includes compression contacts or solderable contacts on at least one surface.

The connector preferably further includes a housing, the at least one carrier, a portion of the at least one cable, and the interposer are preferably inside of the housing.

Preferably, the at least one carrier includes at least one carrier hole; the housing includes at least one lateral housing hole; the at least one carrier hole is arranged to align with the at least one lateral housing hole; and a rod extends into each of the at least one lateral housing hole and through the at least one carrier hole to mechanically secure the at least one carrier to the housing. Preferably, the housing includes at least one vertical housing hole arranged to receive a guide mounted to the main PCB, and the connector is secured to the main PCB by a fastener. The fastener is preferably a threaded screw.

A connector mountable to a main printed circuit board (PCB) according to a preferred embodiment of the present invention includes at least one carrier, at least one cable mounted to the at least one carrier, and at least one press-fit contact that is connected to the at least one cable and that routes signals between the at least one cable and the main PCB when the connector is mounted to the main PCB. The at least one cable is vertically mounted in the connector such that the at least one cable is perpendicular or substantially perpendicular to a mounting surface of the main PCB.

The connector further preferably includes a ground plate connected to the at least one carrier. The connector further preferably includes a clip to which the ground plate is connected. The clip preferably includes at least one groove that receives the at least one cable. The at least one cable preferably is a twinaxial cable.

The above and other features, elements, steps, configurations, characteristics and advantages of the present invention will become more apparent from the following detailed description of preferred embodiments of the present invention with reference to the attached drawings.

BRIEF DESCRIPTION OF THE DRAWINGS

FIGS. 5D(1) to 5D(8) are side and perspective views showing a method of assembling the cable/carrier assembly shown in FIG. 4, mounting the cable/carrier assembly shown in FIG. 4 to the intermediate PCB shown in FIGS. 5A and 5B, and forming the connector assembly shown in FIG. 5C.

FIGS. 6B(1) to 6B(4) are side and perspective views showing a method of introducing rods into the housing shown in FIG. 6A.

DETAILED DESCRIPTION OF PREFERRED EMBODIMENTS

Preferred embodiments of the present invention will now be described in detail with reference to FIGS. 1 to 16. Note that the following description is in all aspects illustrative and not restrictive and should not be construed to restrict the applications or uses of the present invention in any manner.

Figure 1A:
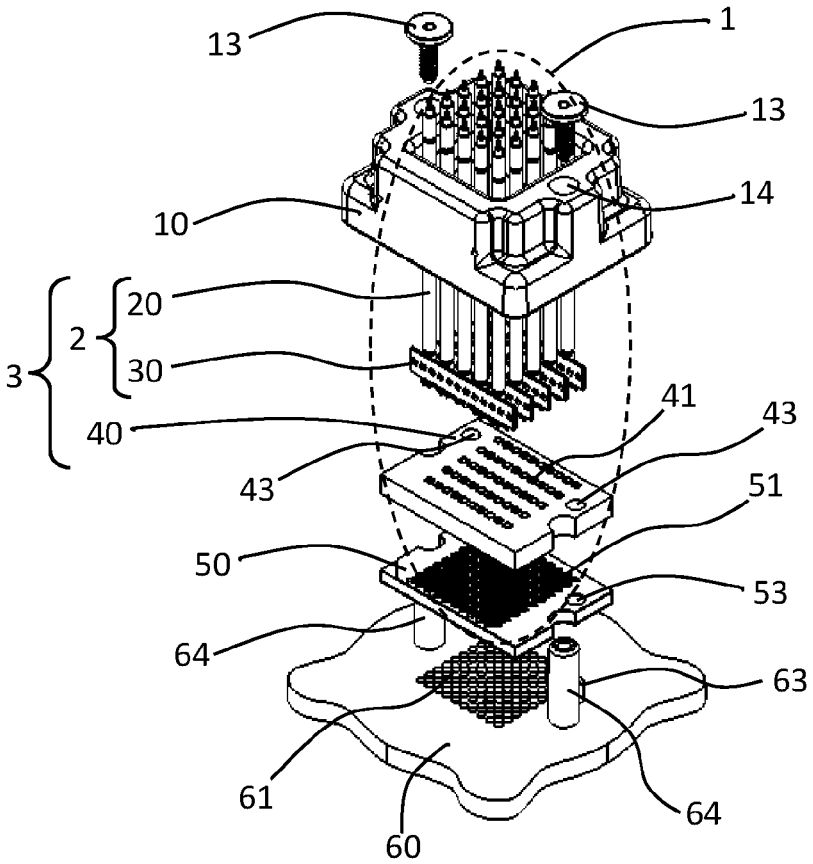
FIG. 1A is an exploded perspective view of a configurable, high-bandwidth connector according to a preferred embodiment of the present invention.

FIGS. 1A to 8 show a configurable, high-bandwidth connector 1 in accordance with a preferred embodiment of the present invention. FIG. 1A is an exploded perspective view of the connector 1, and FIG. 1B is a perspective view of the connector 1 shown in FIG. 1A mounted to a main PCB 60.

As shown in FIG. 1A, the connector 1 includes a housing 10, a connector assembly 3, and an interposer 50. The connector assembly 3 includes cable/carrier assemblies 2 and an intermediate PCB 40, and the cable/carrier assembly 2 includes cables 20 and a carrier 30. Any number of cable/carrier assemblies 2 and any number of cables can be used. The connector 1 can transmit high-bandwidth signals between the cables 20 and the main PCB 60. The connector 1 can include different cable types, cable diameters, and contact pitches. Any suitable substrate can be used instead of main PCB 60.

Figure 10:
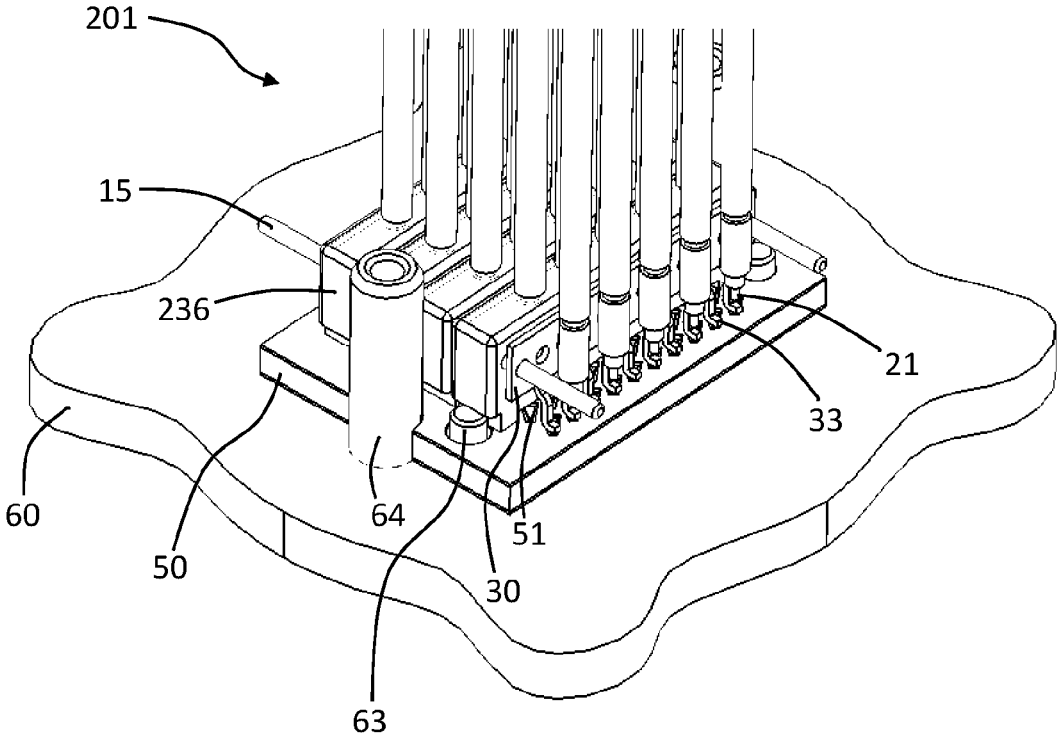
FIG. 10 is a perspective view of a connector without an intermediate PCB according to a preferred embodiment of the present invention.

Any suitable electronic components, such as integrated circuits, resistors, capacitors, and inductors, can be mounted to the main PCB 60. For simplicity, such electronic components are not shown in FIG. 1A. The main PCB 60 preferably includes a contact matrix 61, guides 64, and alignment pins 63. The contact matrix 61 provides electrical connection points for the signals transmitted to and from the cables 20. The guides 64 provide rough alignment for the connector 1 to the main PCB 60, and the guides 64 preferably have internal threads that mate with fasteners 13 to secure the connector 1 to the main PCB 60. The alignment pins 63, as most easily seen in FIG. 10, provide high precision alignment, preferably for at least the intermediate PCB 40 and the interposer 50. Although a preferable alignment tolerance is about ±0.002", this tolerances could be more or less.

Figure 2:
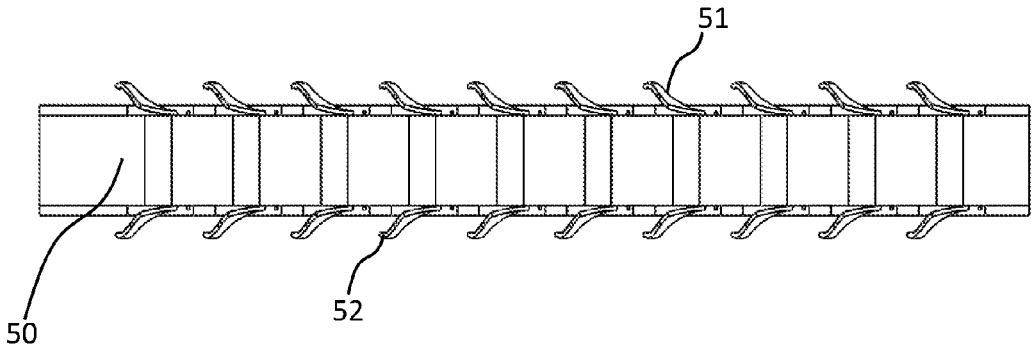
FIG. 2 is a side view of an interposer with dual compression contacts included in the connector shown in FIG. 1A.

FIG. 2 is a side view of the interposer 50 included in the connector 1 shown in FIG. 1A. As shown in FIG. 2, the interposer 50 can have dual compression contacts that include first compression contacts 51 on an upper surface and second compression contacts 52 on a lower surface. The interposer 50 can be made with typical PCB materials, including, for example, FR4 and METRON 6. The upper and lower compression contacts 51 and 52 can be connected to each other by through hole vias in the interposer 50.

The interposer 50 is preferably arranged between the intermediate PCB 40 and the main PCB 60, as shown in FIG. 1A. The interposer 50 routes signals and ground connections to and from the intermediate PCB 40 and the main PCB 60. The first compression contacts 51 of the interposer 50 mate with vias 41 of the intermediate PCB 40, and the second compression contacts 52 of the interposer 50 mate with the contact matrix 61 on the main PCB 60. Interposer 50 can be, for example, the Z-Ray™ interposer manufactured by Samtec Inc. of New Albany, Ind., but any other suitable interposer could also be used. For example, the interposer 50 can preferably have a contact pitch of between about 0.8 mm and about 1.0 mm, within manufacturing tolerances, but other contact pitches can be used. The interposer 50 determines the contact count and/or contact density of the connector 1. For example, the interposer 50 can have 1,024 contact/in$^2$, but other contact densities are possible.

The interposer 50 preferably includes double compression contacts as shown in FIG. 2, but other contact arrangements can be used, including, for example, compression contacts on one side of the interposer 50 and solder balls on the other side of the interposer 50. Preferably, the compression contacts include a spring that provides the mechanical force to make physical and electrical contact between the interposer contacts (e.g., first and second compression contacts 51 and 52) and contacts on the mating components, including the vias 41 of the intermediate PCB 40 and the contact matrix 61 of the main PCB 60. The dual compression contacts of the interposer 50 permit electrical connections to be made without soldering the interposer 50 to either the intermediate PCB 40 or the main PCB 60. However, if the interposer 50 only includes single compression contacts, the solder balls on the opposite surface of the single compression contacts are typically used to electrically connect the interposer 50 to the contact matrix 61 of the main PCB 60 by soldering the interposer 50 to the main PCB 60. However, solder balls can also be used to electrically connect the interposer 50 to the intermediate PCB 40.

The interposer 50 preferably includes guide holes 53 that receive the alignment pins 63 of the main PCB 60 to align the second compression contacts 52 of the interposer 50 with the contact matrix 61 on the main PCB 60. However, the guide holes 53 can be replaced by any other suitable type of alignment feature(s).

Figure 1B:
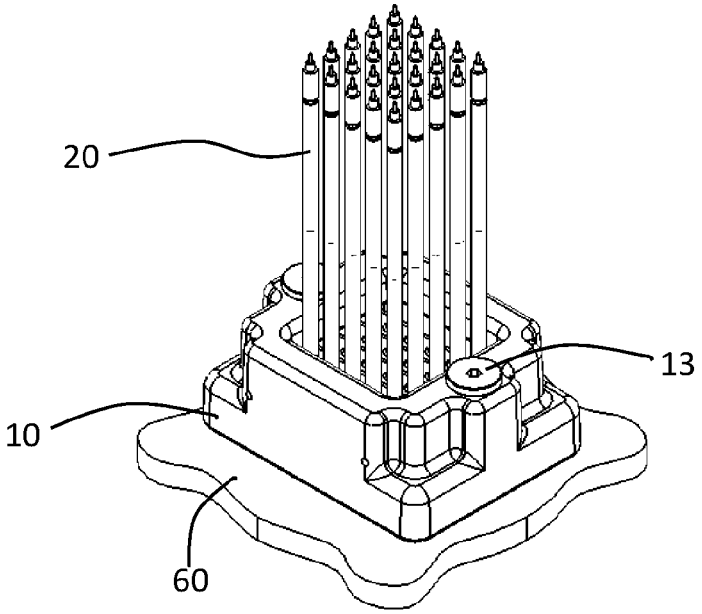
FIG. 1B is a perspective view of the connector shown in FIG. 1A mounted to a main PCB.

An intermediate PCB 40 can be adjacent to the interposer 50. The intermediate PCB 40 provides a routing path for signals and ground connections, as well as mechanical support for one or more carriers 30. The intermediate PCB 40 receives and supports the one or more carriers 30 on the side of the intermediate PCB 40 opposite to the interposer 50. Although five carriers 30 are shown in FIGS. 1A and 1B, any number of carriers 30 can be used, including, for example, a single carrier 30, as shown in FIG. 5B. The carriers 30 are preferably soldered to the intermediate PCB 40. Alternatively, the carriers 30 could be mounted to the intermediate PCB 40 in any suitable manner, including, for example, being press-fit to the intermediate PCB 40. The carriers 30 provide mechanical support for the cables 20 and electrical paths for ground connections.

The intermediate PCB 40 preferably includes guide holes 43 that receive the alignment pins 63 of the main PCB 60 to align the vias 41 of the intermediate PCB 40 with the first compression contacts 51 on the interposer 50. However, the guide holes 43 can be replaced by any other suitable type of alignment feature(s).

The cables 20 are attached to the carriers 30. Preferably, the cables 20 include one or more center conductors 21 surrounded by a dielectric 22, a ground shield 23, and an outer insulation 24. Any suitable type of cable can be used, including, for example, coaxial cables (as shown in FIGS. 1A-8) or twinaxial cables (as shown in FIGS. 11-13, 15, and 16). However, the cables 20 can alternatively be discrete, unshielded wire. The cables 20 can include the same or different size center conductors 21, including, for example, 30 AWG (American Wire Gauge), 32 AWG, or 34 AWG. Other sizes or gauges can also be used. The cables 20 can also have the same or different characteristic impedances, including, for example, 50 Ω, 80Ω, or 100Ω. Other cable impedance values can also be used.

Preferably, the connector 1 includes a housing 10 that provides mechanical support and strain relief for the cables 20. The housing 10 can be inexpensively fabricated from molded plastic, for example. The housing 10 can be made of other suitable materials, including, for example, plated plastic, Cu-metal injected molding, zinc casting, brass, aluminum, and lossy liquid crystal polymer (LCP). If the housing includes a conductive material, then the housing can provide a ground or shielding. The housing 10 preferably includes vertical housing holes 14 that receive fasteners 13. Fasteners 13 secure the connector 1 to the main PCB 60. Preferably, the fasteners 13 are threaded screws that engage with internal threads in the guides 64. The fasteners 13 are preferably made from a durable material such as brass. However, any suitable metal could be used. However, other suitable types of fasteners 13 and/or fastening arrangements can be used to secure the connector 1 to the main PCB 60. For example, instead of being threaded screws, the fasteners 13 could be latches or snap arms, which could be made of metal or plastic.

FIG. 1B shows the connector 1 attached to the main PCB 60. Only the fasteners 13, the housing 10, the cables 20, and the main PCB 60 are shown in FIG. 1B. All the other elements shown in FIG. 1A are present in the assembly (carriers 30, intermediate PCB 40, interposer 50, etc.), but are not visible because they are obscured by the housing 10. The fasteners 13 have been tightened down to secure the connector 1 to the main PCB 60. As shown in FIG. 1B, the cables 20 connected to the connector 1 are in an orientation at the point of attachment to the connector 1 that is perpendicular or substantially perpendicular within manufacturing tolerances to a major planar surface of the main PCB 60. This type of mounting is referred to as "vertical mounting" in contrast to the more commonly-used "horizontal mounting" in which cables are parallel or substantially parallel to a major planar surface of substrate. Because the cables 20 can be bent, the portion of the cables 20 spaced away from the point of attachment can have any orientation. This is one of the benefits of using a cable. "Vertical mounting" and "horizontal mounting" refer to the orientation of the cable 20 at the point of attachment and does not refer to the orientation of the cable 20 spaced away from the point of attachment where the cable can be bent in any orientation. One advantage of vertical mounting is that the trace lengths between the connector 1 and any electronic components mounted to the main PCB 60 can be significantly reduced or minimized because these electronic components can be mounted around the periphery of the connector 1. In contrast, horizontal mounting requires the connector to be connected at an edge of the main mounting surface or substrate, which provides less nearby mounting space for electronic components.

A method of assembling the connector 1 is described in more detail below, with respect to FIGS. 3A to 6B(4).

Figure 3A:
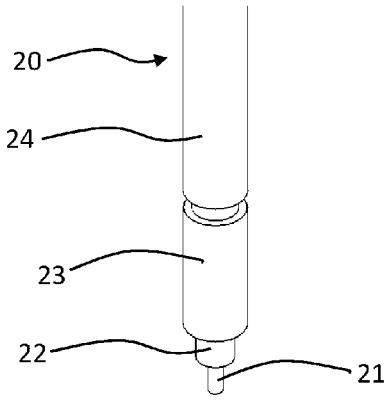
FIG. 3A is a perspective view of a cable end termination of a cable included in the connector shown in FIG. 1A.
Figure 3B:
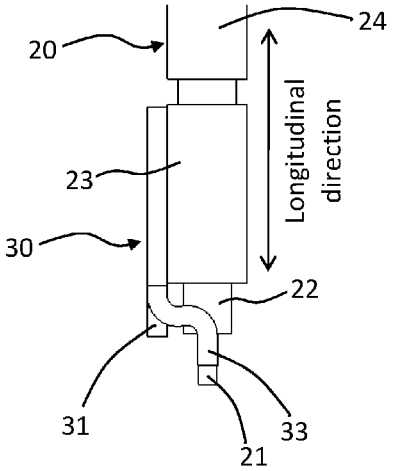
FIGS. 3B and 3C are side and perspective views of the cable shown in FIG. 3A mounted to a carrier.
Figure 3C:
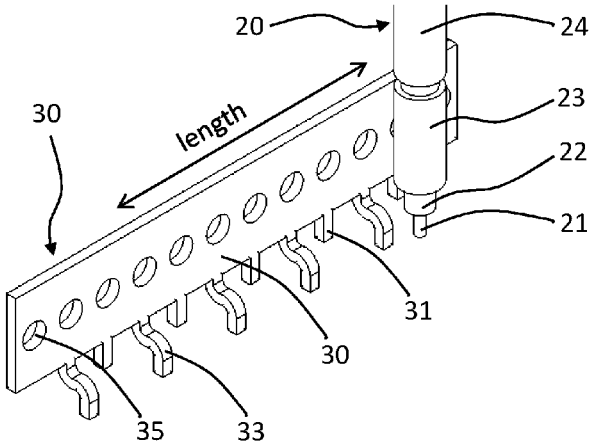
Figure 4:
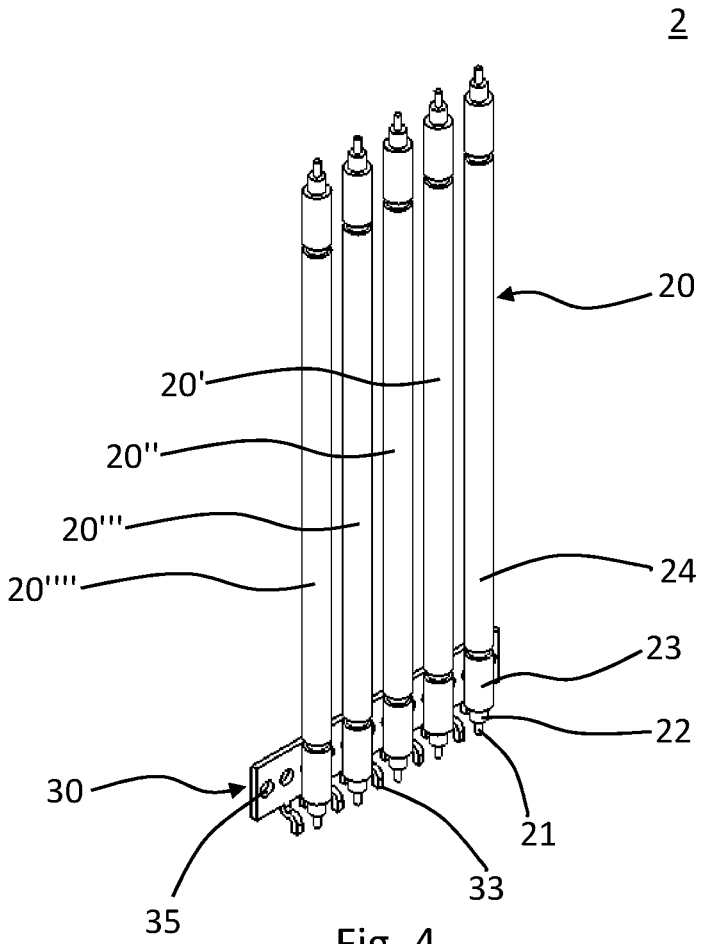
FIG. 4 is a perspective view of a completed cable/carrier assembly including a plurality of cables with the cable end termination shown in FIG. 3A mounted to the carrier shown in FIGS. 3B and 3C.

FIGS. 3A to 4 show a process of preparing the cable/carrier assembly 2. More specifically, FIG. 3A is a perspective view of an end of one of the cables 20 included in the connector 1 shown in FIG. 1A. FIGS. 3B and 3C are side and perspective views of the cable shown in FIG. 3A mounted to a carrier 30. FIG. 4 is a perspective view of a completed cable/carrier assembly 2 including a plurality of the cables 20, with an end as shown in FIG. 3A, mounted to the carrier 30 shown in FIGS. 3B and 3C.

Figure 11:
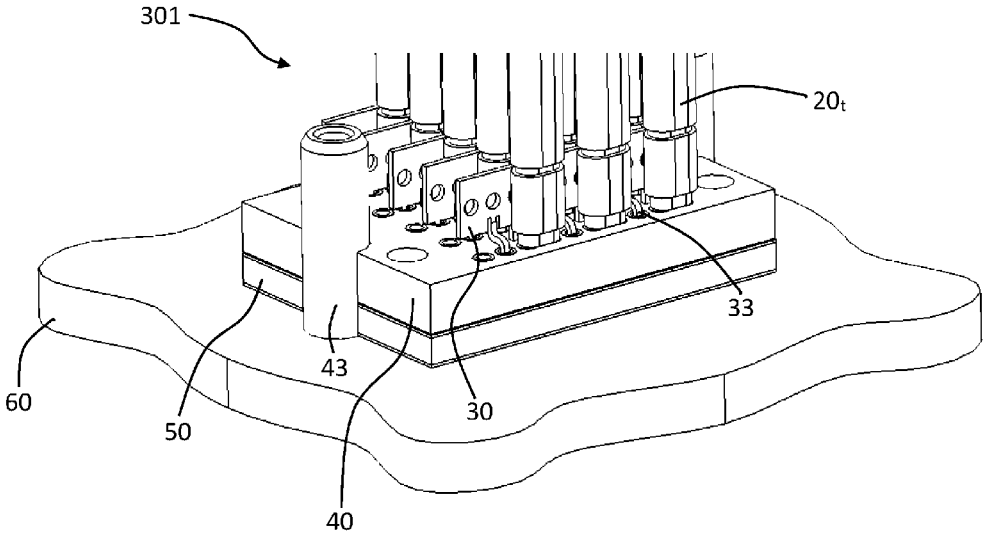
FIG. 11 is a perspective view of a connector with twinaxial cable according to a preferred embodiment of the present invention.
Figure 16:
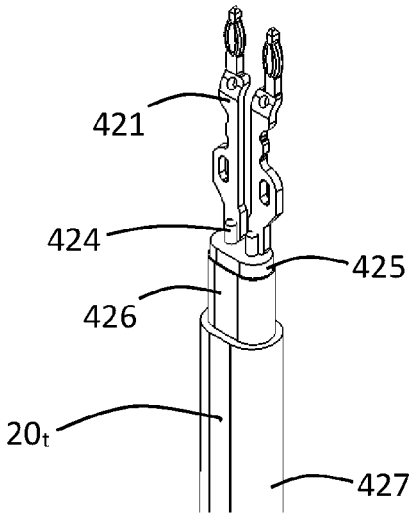
FIG. 16 is a perspective view of a portion of the twinaxial cable shown in FIG. 15.

FIG. 3A shows an end of one of the cables 20. The end of the cable 20 is stripped so that the center conductor 21 is exposed and extends past the end of the dielectric 22. The ground shield 23 is also stripped back so that a short length of dielectric 22 is exposed. In addition, the outer insulation 24 of the cable 20 is stripped back so that a length of the ground shield 23 is exposed. Although FIG. 3A shows a coaxial cable, other types of cable can be used with appropriate modifications to the assembly procedures. For example, if a twinaxial cable $20_t$ is used, as shown in FIGS. 11 and 16, two center conductors are included in each cable, and each of these center conductors is stripped back in a similar manner. Preferably, the length of the center conductor 21 not surrounded by the ground shield 23 is significantly reduced or minimized to curtail reflection losses and crosstalk. The center conductor 21 can be made of any suitable conductive material, including, for example, Ag-plate copper and Sn-plated copper. The dielectric 22 can be made of any suitable dielectric material, including, for example, Teflon®, fluorinated ethylene propylene (FEP), perfluoroalkoxy alkane (PFA), polytetrafluoroethylene (PTFE), and expanded PTFE (EPTFE). The ground shield can be any suitable conductive material, including, for example, Ag-plate copper, Sn-plated copper, and copper foil. The outer insulation can be made of any suitable insulating material, including, for example, polyvinyl chloride (PVC), terpolymer of tetrafluoroethylene, hexafluoropropylene, and vinylidene fluoride copolymer (THV), Teflon®, FEP, PFA, PTFE, and EPTFE.

The carrier 30 can be inexpensively fabricated from a stamped plated metal. For example, the carrier 30 can be fabricated from a beryllium copper alloy, but any other suitable material(s) can also be used. As shown in FIG. 3C, the carrier 30 preferably includes carrier holes 35, prongs 33, and tabs 31 that help with alignment, improve mechanical integrity, and help establish a stable and effective electrical ground. The prongs 33 and tabs 31 are preferably arranged in an alternating pattern such that each tab 31 has prongs 33 on both sides of the tab 31 along the length of the carrier 30, as shown in FIG. 3C. The carrier holes 35 are preferably arranged along the length of the carrier 30, as shown in FIGS. 3B and 3C.

FIGS. 3B and 3C show the connection between the cable 20 and the carrier 30. Preferably, the ground shields 23 of the cables 20 are attached to the carrier 30 using solder, which provides both a good mechanical and electrical connection between the ground shields 23 of the cables 20 and the carrier 30. However, the cables 20 can be attached to the carrier 30 in any other suitable manner, including, for example, crimping, ultrasonic welding, resistance welding, and laser soldering. The cable 20 can be positioned on the carrier 30 to align or substantially align within manufacturing tolerances the cable 20 with a tab 31 and/or a carrier hole 35, as shown in FIGS. 3B and 3C. The tabs 31 provide an extended surface for soldering the ground shields 23 of the cables 20 to the carrier 30, which provides mechanical strength and rigidity to the cable/carrier assembly 2 and which act as a further grounding shield for the center conductor 21. The carrier holes 35 provide alignment features for the cables 20, improve the strength of the solder bond between the cables 20 and carrier 30, and help provide strain relief for the cables 20. The cables 20 can be positioned on the carrier 30 so that the end of each of the center conductors 21 is aligned or substantially aligned within manufacturing tolerances with, or slightly protrudes past, the end of each of the corresponding prongs 33. The center conductors 21 and prongs 33 can be aligned in a single row. The prongs 33 provide electrical ground connections adjacent to the center conductors 21, which improves impedance matching for the signal paths through the connector 1.

The solder connection between the cables 20 and carrier 30 is preferably made using a hot-bar solder process. First, the carrier 30 and the ground shields 23 of the cables 20 are pre-tinned prior to application of pulsed heat by a hot-bar solder tool. Preferably, the hot-bar solder tool includes alignment features that help position the cables 20 with respect to the carrier 30. After a first cable 20 is installed on the carrier 30, other cables (labeled 20' to 20'''' in FIG. 4) can be installed in a similar manner to form the cable/carrier assembly 2 as shown in FIG. 4. The cables 20 can be simultaneously or nearly simultaneously soldered to the carrier 30. Alternatively, the cables 20 can be sequentially soldered to the carrier 30. If a defect is found or occurs in one of the cables 20, the cable/carrier assembly 2 can be reworked by removing the defective cable and soldering in a replacement cable.

FIG. 4 shows the carrier 30 with five mounted cables (labeled 20, 20', 20'', 20''', 20'''' in FIG. 4), which populate all the cable positions on the carrier 30 shown in FIG. 4. However, the carrier 30 can have fewer than five cable positions or more than 5 cable positions. In addition, not every cable position of the carrier 30 needs to be populated with a cable 20. Different numbers of cables 20 can be readily accommodated on the carrier 30 by appropriately populating the cable positions and scaling the length of the carrier 30. The cable positions of the carrier 30 can be populated by the same type or by different types of cables. Different cable/carrier assemblies can also be used in the connector assembly 3. For example, as shown in FIG. 11, twinaxial cables $20_t$ can be used in place of, or in addition to, the cables 20, which are coaxial cables. Preferably, the two center conductors of the twinaxial cables $20_t$ are both situated between each prong 33 of the carrier 30.

Figure 5A:
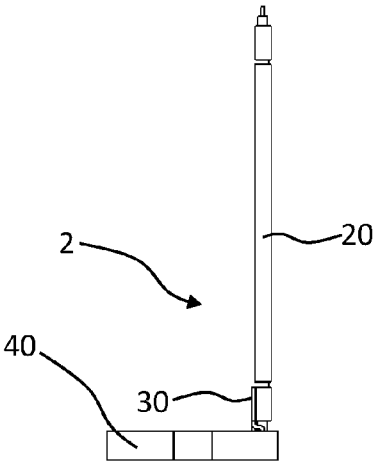
FIGS. 5A and 5B are side and perspective views of the cable/carrier assembly shown in FIG. 4 mounted to an intermediate PCB.
Figure 5B:
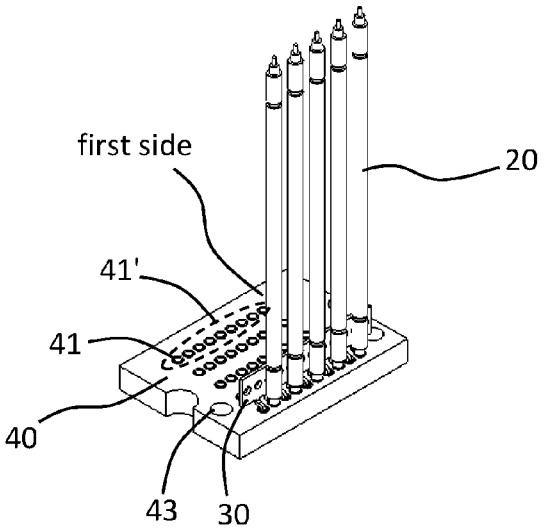
Figure 5C:
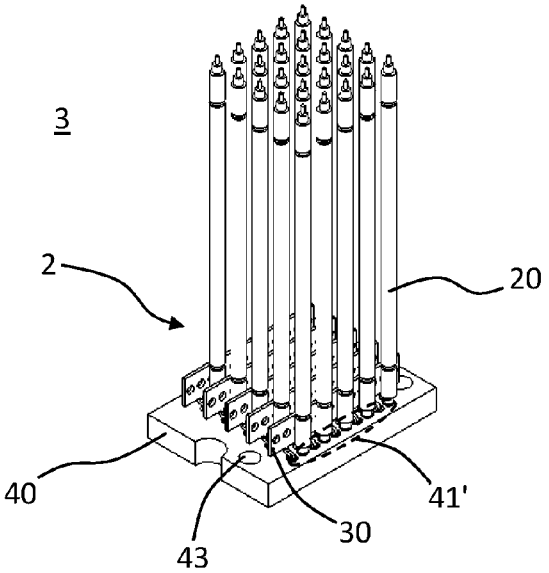
FIG. 5C is a perspective view showing the intermediate PCB shown in FIGS. 5A and 5B fully populated with a plurality of the cable/carrier assemblies shown in FIG. 4, defining a connector assembly.

FIGS. 5A to 5D(8) show a process of mounting the cable/carrier assembly 2 to the intermediate PCB 40 to form the connector assembly 3. More specifically, FIGS. 5A and 5B are side and perspective views of the cable/carrier assembly 2 shown in FIG. 4 mounted to the intermediate PCB 40. FIG. 5C is a perspective view showing the intermediate PCB 40 shown in FIGS. 5A and 5B fully populated with the cable/carrier assemblies 2 shown in FIG. 4, thereby forming the connector assembly 3. FIGS. 5D(1) to 5D(8) are side and perspective views showing a method of assembling the cable/carrier assembly 2 shown in FIG. 4, mounting the cable/carrier assembly 2 shown in FIG. 4 to the intermediate PCB 40 shown in FIGS. 5A and 5B, and forming the connector assembly 3 shown in FIG. 5C.

FIGS. 5A and 5B show the connection between the cable/carrier assembly 2 and the intermediate PCB 40. The vias 41 of the intermediate PCB 40 can be positioned in one or more rows 41', as shown in FIG. 5B. The prongs 33 of the carrier 30 and the center conductors 21 of the cables 20 are located in the vias 41 of the intermediate PCB 40. For an intermediate PCB 40 with multiple rows 41' of vias 41, each via row 41' can be mated with a single cable/carrier assembly 2. For an intermediate PCB 40 with only a single via row 41', cable/carrier assembly 2 can be mated to that single via row 41'. It is also possible that one via row is mated with two or more cable/carrier assemblies 2. The intermediate PCB 40 and the cable/carrier assemblies 2 can be soldered together. For example, the solder can be applied to the center conductors 21, prongs 33, and vias 41 as a solder paste and then reflowed to provide good mechanical and electrical connections between the cable/carrier assemblies 2 and the intermediate PCB 40.

Figure 7:
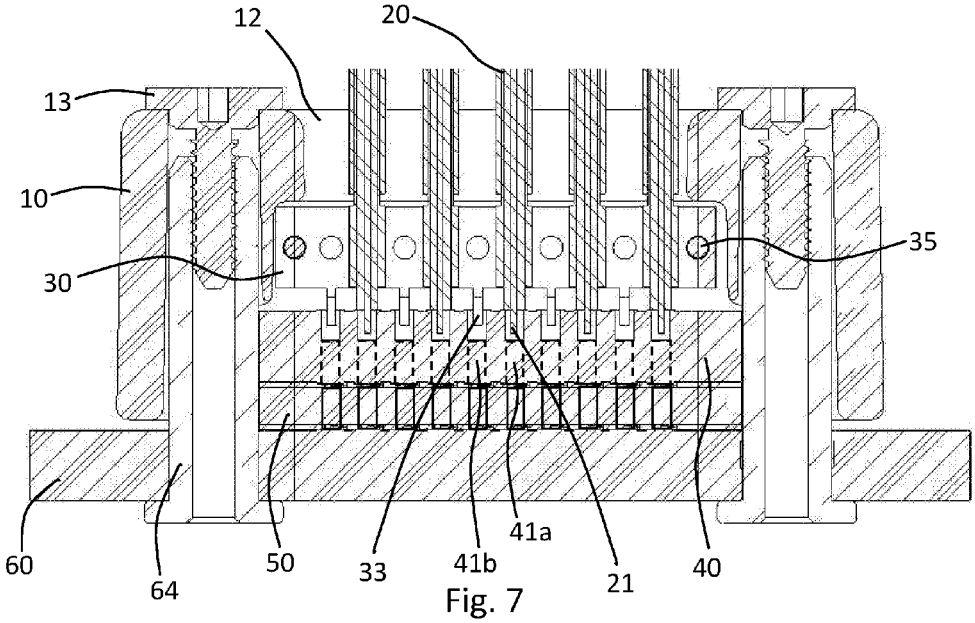
FIG. 7 is a cross-sectional side view of the connector shown in FIGS. 1A and 1B mounted to a main PCB.
Figure 8:
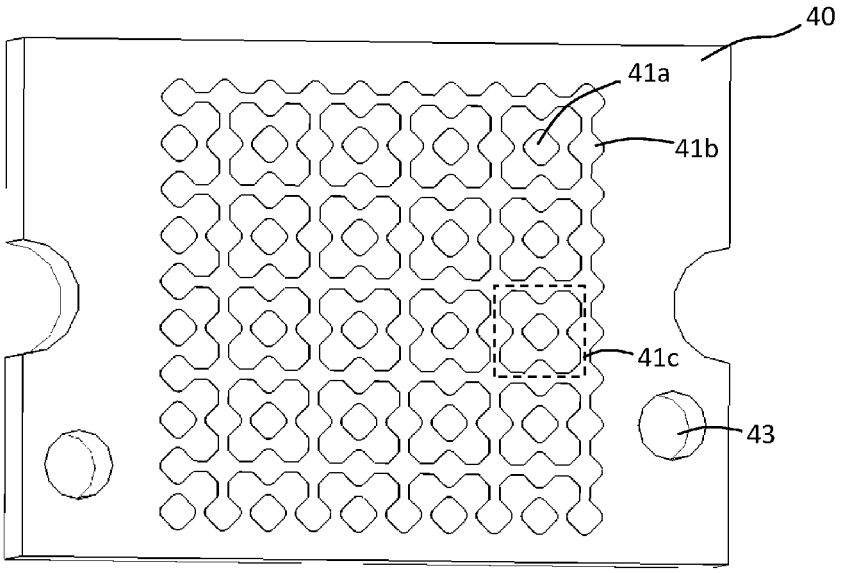
FIG. 8 is a view of the lower surface of the intermediate PCB shown in FIGS. 5A to 5C.

As shown in FIGS. 7 and 8, the vias 41 extend through the intermediate PCB 40 to the opposing, second side of the intermediate PCB 40, terminating in signal path vias 41*a* and ground path vias 41*b*. Preferably, each of the signal path vias 41*a*, which are connected to the center conductors 21, is surrounded or substantially surrounded by a corresponding ground region 41*c* as the signal path via 41*a* traverses the intermediate PCB 40 to significantly reduce or minimize crosstalk, loss, and back reflection as signals are transmitted through the connector 1.

FIG. 5C shows cable/carrier assemblies 2 mounted to the intermediate PCB 40, forming the connector assembly 3. In FIG. 5C, each cable/carrier assembly 2 preferably has five cables 20, and the intermediate PCB 40 preferably has five via rows 41', each of which is populated with a corresponding cable/carrier assembly 2. Thus, the connector assembly 3 includes 5×5=25 total high-bandwidth signal channels. Each signal channel is preferably able to support multi-GHz data transmission bandwidths. More preferably, the data transmission rates are at least 28 GHz. The data transmission rates can be compatible with various industrial standards such as, but not limited to, Infiniband, Gigabit Ethernet, Fibre Channel, SAS, PCIe, XAUI, XLAUI, XFI, and the like.

Each center conductor 21 of the cables 20 is preferably surrounded by two prongs 33 of the carriers 30 on the cable/carrier assembly 2, which are electrically connected to ground. Each center conductor 21 can also be adjacent to two tabs 31, one on the cable/carrier assembly 2 holding the center conductor 21 and one on an adjacent cable/carrier assembly 2. The prongs 33 and tabs 31 help to shield signals being transmitted through the center conductors 21. Although FIG. 5C shows that all of the cables 20 are the same, different cable types and sizes can be used in a single connector. For example, a single connector can include coaxial cable, twinaxial cable, and/or cable of discrete wires. Accordingly, the connector 1 can be easily adapted or optimized for each specific application.

Figure 6A:
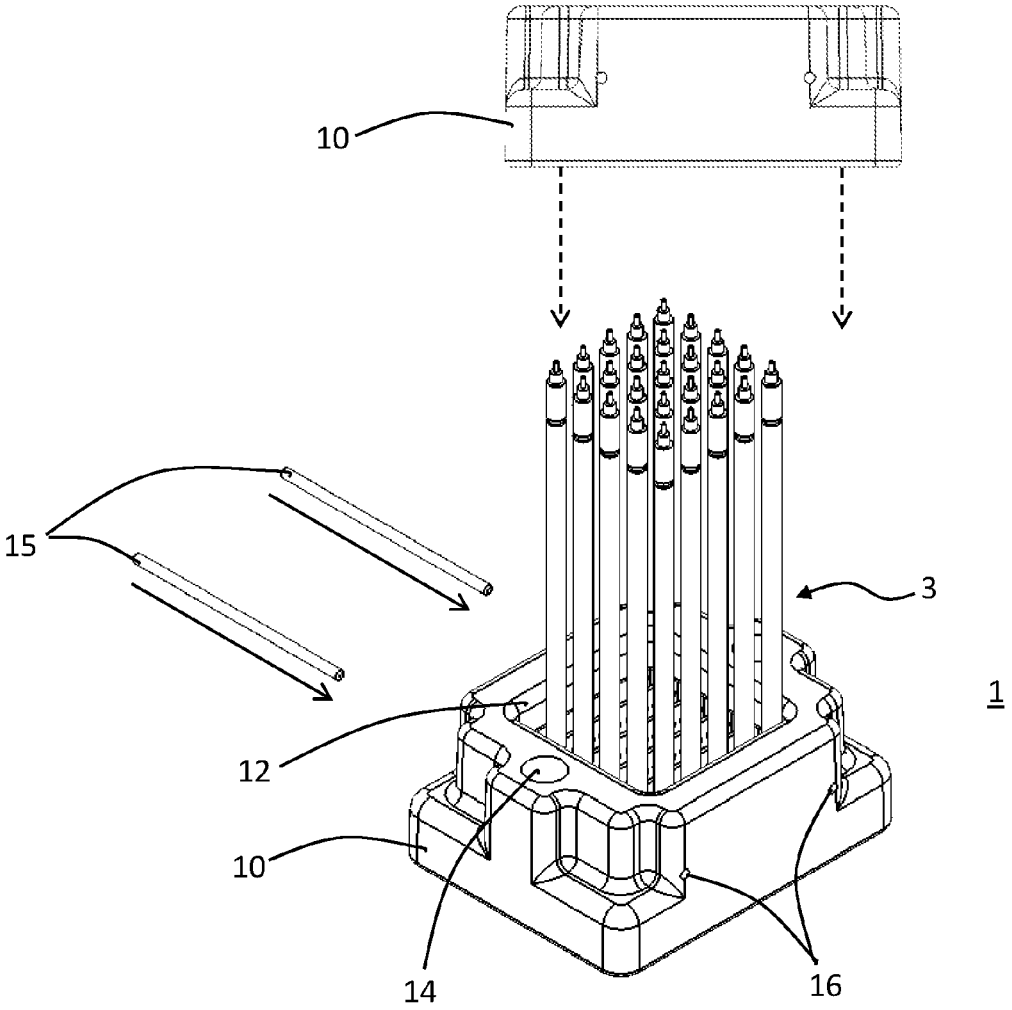
FIG. 6A is a perspective view of a housing being mounted to the connector assembly shown in FIG. 5C.

FIGS. 6A to 6B(4) show a process of assembling the connector 1 by mounting the housing 10 to the connector assembly 3. More specifically, FIG. 6A is a perspective view of the housing 10 being mounted to the connector assembly 3 shown in FIG. 5C. FIGS. 6B(1) to 6B(4) are side and perspective views showing a method of introducing rods 15 into the housing 10 shown in FIG. 6A.

FIG. 6A shows some of the final steps in assembling the connector 1. As described above, the connector assembly 3 can include multiple cable/carrier assemblies 2 connected to the intermediate PCB 40. The housing 10 is positioned over the connector assembly 3 such that the housing 10 surrounds or substantially surrounds the connector assembly 3 with the cables 20 protruding through a cable opening 12 in the housing 10. In many applications, the length of the cables 20 can have a length of 1 m or less; however, this is not a limitation and longer cable lengths can be used. The housing 10 can be secured to the connector assembly 3 with one or more rods 15. Preferably, the rods 15 pass through lateral housing holes 16 in the housing 10 and engage with carrier holes 35 of the carriers 30, providing a mechanical connection between the housing 10 and connector assembly 3. After inserting the rods 15, the rods 15 can be secured to the housing 10 with an adhesive or in some other suitable manner. The fasteners 13 (not shown in FIG. 6A) can be inserted into the vertical housing holes 14 to allow attachment of the connector 1 to the main PCB 60 using the interposer 50 as shown in FIGS. 1A and 1B. In addition, the housing can be filled with epoxy after the cables 20 are connected to provide additional mechanical strength and strain relief. Any suitable non-conductive epoxy can be used.

FIG. 7 is a cross-sectional side view of the connector 1 shown in FIGS. 1A and 1B mounted to the main PCB 60. FIG. 7 shows a schematic cross-section of the connector 1 attached to the main PCB 60. The connector 1 includes cables 20 mounted to the carrier 30, as described above. The connector 1 is electrically connected to the main PCB 60 using the interposer 50 between the connector assembly 3 and the main PCB 60. The prongs 33 of the carrier 30 and the center conductors 21 of the cables 20 fit into vias 41 in the intermediate PCB 40.

The vias 41 in the intermediate PCB 40 can be blind vias. Blind vias can be formed by first forming a via through the intermediate PCB 40, filling a portion of the via with a conductive material (shown by the rectangles with broken lines in FIG. 7), and then plating the portion of the via into which the prong 33 or center conductor 21 will be inserted.

Electrically conductive signal paths (corresponding to signal path vias 41*a* in FIG. 7) route signals to and from the center conductors 21 of the cables 20 through the intermediate PCB 40 and the interposer 50 from/to the main PCB 60. Electrically conductive ground paths (corresponding to ground path vias 41*b* in FIG. 7) establish a ground region substantially surrounding the signal paths through the intermediate PCB 40 and the interposer 50. The signal path length between the end of the ground shield 23 and entry into the main PCB 60 is relatively short (preferably less than about 5 mm), which significantly reduces or minimizes the length of possible impedance mismatch between the cable 20 and the various elements of the connector 1.

FIG. 8 is a view of lower surface of the intermediate PCB 40 shown in FIGS. 5A to 5C. FIG. 8 shows the second side of the intermediate PCB 40. In FIG. 8, the cables 20 can be mounted to a first (upper) surface of the intermediate PCB 40 (the side of the intermediate PCB 40 shown in FIG. 1A), as described above. A second (lower) surface of the intermediate PCB 40 includes a regular array of signal paths. As shown in FIG. 8, 25 signal paths (corresponding to signal path vias 41*a*) are arranged in a 5×5 array. However, more or fewer signal paths can be used. Each signal path can be surrounded by a ground region 41*c*. The ground region 41*c* is the region defined by the ground signal paths (corresponding to ground path vias 41*b*) that surround each signal path and that are electrically connected together. These electrical connections can be made using suitable patterning techniques used in PCB fabrication. In addition, the ground region 41*c* can extend into the main PCB 60, which further reduces crosstalk between the signal paths.

Figure 9:
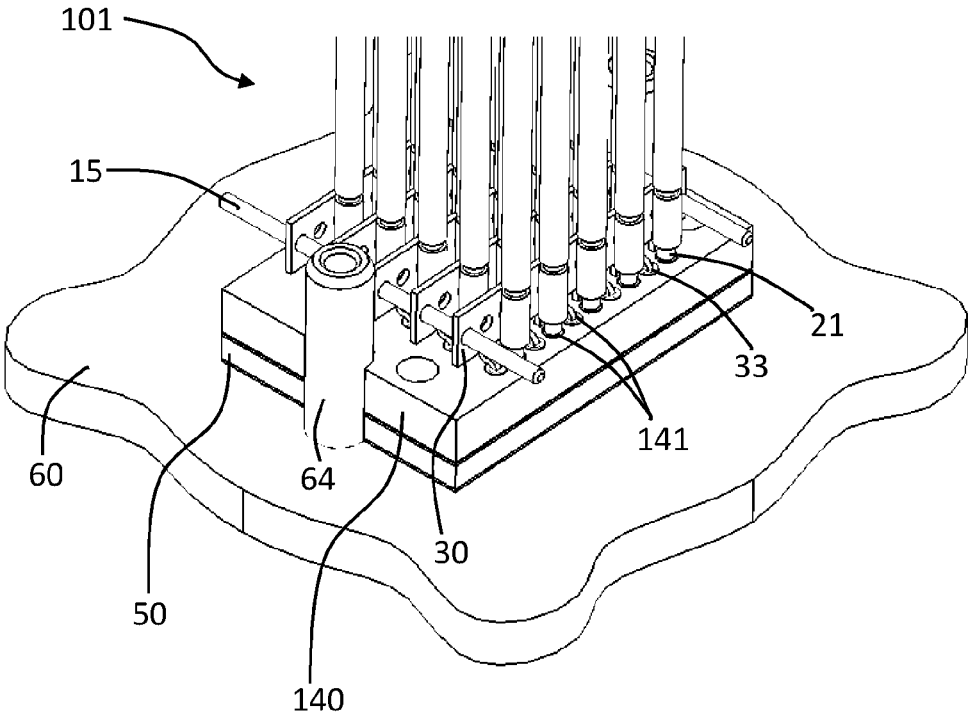
FIG. 9 is a perspective view of a connector using a surface-mount-technology intermediate PCB according to a preferred embodiment of the present invention.

FIG. 9 is a perspective view of connector 101 using a surface-mount intermediate PCB 140, according to another preferred embodiment of the present invention. For clarity, the housing 10 is not shown in FIG. 9. As shown in FIG. 9, the intermediate PCB 40 that uses via-based mounting can be replaced with an intermediate PCB 140 that uses surface mounting. The assembly and method of assembly of the connector 101 is generally similar to the connector 1 described above, except that the vias 41 of the intermediate PCB 40 have been eliminated, and surface-mount technology is used to connect the cable/carrier assembly 2 and the intermediate PCB 140. When the surface-mount intermediate PCB 140 is used, the lengths of the prongs 33 of the carrier 30 and the lengths of the stripped center conductor 21 of the cables 20 can be modified from the lengths described above. In particular, the ends of the prongs 33 and the center conductors 21 preferably lie in a common plane or substantially a common plane within manufacturing tolerances so that surface-mount connections between pads 141 of the surface-mount PCB 140 and the prongs 33 and center conductors 21 can be made simultaneously or substantially simultaneously within manufacturing tolerances. The surface-mount connections are preferably made using suitable surface-mount soldering techniques. Surface-mount technology can reduce connector cost, shorten the signals paths through the main PCB 60, and enable shorter pitch dimensions.

FIG. 10 is a perspective view of a connector 201 without an intermediate PCB. For clarity, the housing 10 is not shown in FIG. 10. FIG. 10 shows a connector 201 that does not include the intermediate PCB 40. The assembly and method of assembly of the connector 201 is generally similar to the connector 1 described above, except that the intermediate PCB 40 has been eliminated. As shown in FIG. 10, electrical connections are made directly from the prongs 33 of the carrier 30 and the center conductors 21 of the cables 20 to the contacts 51 of interposer 50. The prongs 33 of the carrier 30 and the center conductors 21 of the cable 20 are arranged such that they align with and make electrical connection with the contacts 51 of the interposer 50. The contacts 51 of the interposer 50 can be the first compression contacts 51 described above, although other contact types can be used, for example, cantilevered-type connections or other types of electrical connections that can be made by mechanical contact.

FIG. 10 shows a cover 236 that is preferably included in the connector 201 and that surrounds the connections between the cables 20 and the carrier 30 (for clarity, one of the carriers 30 is shown without a cover 236). Although not shown, the housing 10 can be included with the connector 201. Since the connector 201 does not include the intermediate PCB 40, the manufacturing cost can be reduced. In addition, the length of the signal path outside of the cable 20 can be short, which reduces loss and crosstalk and which supports high-bandwidth operation.

FIG. 11 is a perspective view of a connector 301 with twinaxial cables $\mathbf{20}_t$. For clarity, the housing 10 is not shown in FIG. 10. As discussed above with respect to FIG. 4, the carrier 30 can have any number of cable positions. However, different types of cables can be used, and different cable/carrier assemblies can also be used. As shown in FIG. 11, twinaxial cables $\mathbf{20}_t$ can be used in place of the (coaxial) cables 20 discussed above. Twinaxial cables $\mathbf{20}_t$ include two center conductors situated between each prong 33.

Figure 12:
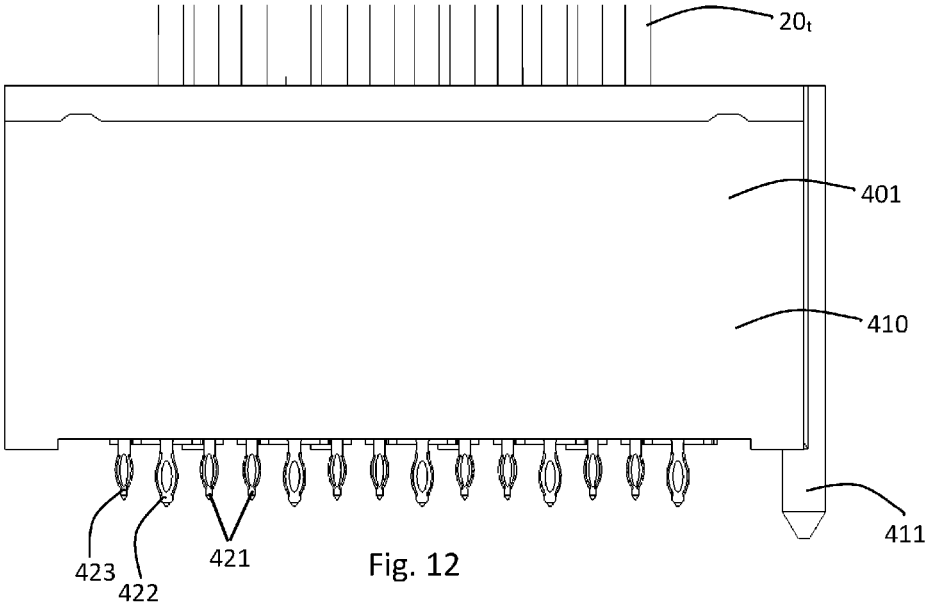
FIGS. 12 and 13 are side views of a connector with press-fit contacts according to a preferred embodiment of the present invention.
Figure 13:
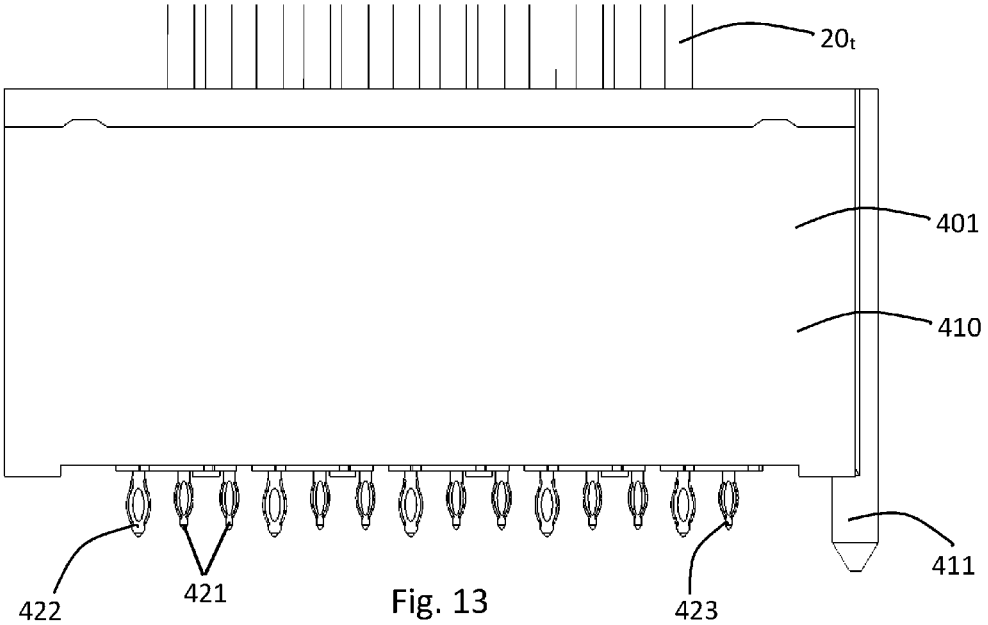

FIGS. 12 and 13 show a connector 401 with press-fit contacts 421, 422, 423. The connector 401 is connected to a main PCB (not shown in FIGS. 12 and 13) by inserting the press-fit contacts 421, 422, 423 into holes in the main PCB. The holes in the PCB are arranged in the same arrangement as the press-fit contacts 421, 422, 423. Because the press-fit contacts 421, 422, 423 connect to the main PCB instead of the compression contacts 52, a fastener 13 is not needed to ensure a physical and electrical connection between the connector 401 and the main PCB. In addition, because the press-fit contacts 421 are connected to the twinaxial cables $\mathbf{20}_t$, the connector 401 does not include an intermediate PCB 40 or an interposer 50.

The connector 401 includes a housing 410 that includes an alignment post 411. Twinaxial cables $\mathbf{20}_t$ are attached to the housing 410. Although twinaxial cables $\mathbf{20}_t$ are attached to the connector 401 in FIGS. 12 and 13, it is possible to use coaxial cables or other suitable cables. The center conductors 424 (not visible in FIGS. 12 and 13 but shown in FIG. 15) of the twinaxial cables $\mathbf{20}_t$ are connected to the press-fit contacts 421. For example, as shown in FIG. 16, the center conductors 424 can be directly connected to the press-fit contacts 421 by soldering. Differential signals can be transmitted by the twinaxial cable $\mathbf{20}_t$ and the press-fit contacts 421. Press-fit contacts 422 can be grounded, which can reduce cross-talk between adjacent pairs of press-fit contacts 421.

For simplicity, only a single row of press-fit contacts is shown in each of FIGS. 12 and 13. In both of FIGS. 12 and 13, adjacent pairs of press-fit contacts 421 are separated by press-fit contact 422, but the adjacent pairs of press-fit contacts 421 in FIGS. 12 and 13 are shifted with respect to each other. In FIG. 12, starting from the left, the first pair of press-fit contacts 421 is defined by the third and fourth contacts, and in FIG. 13, starting from the left, the first pair of press-fit contacts 421 is defined by the second and third contacts. FIG. 12 includes a dummy press-fit contact 423 on the left side, and FIG. 13 includes a dummy press-fit contact 423 on the right side. Other arrangements of press-fit contacts 421, 422, 423 can be used. For example, it is possible not to use grounded press-fit contacts 422 and/or dummy press-fit contacts 423.

Figure 14:
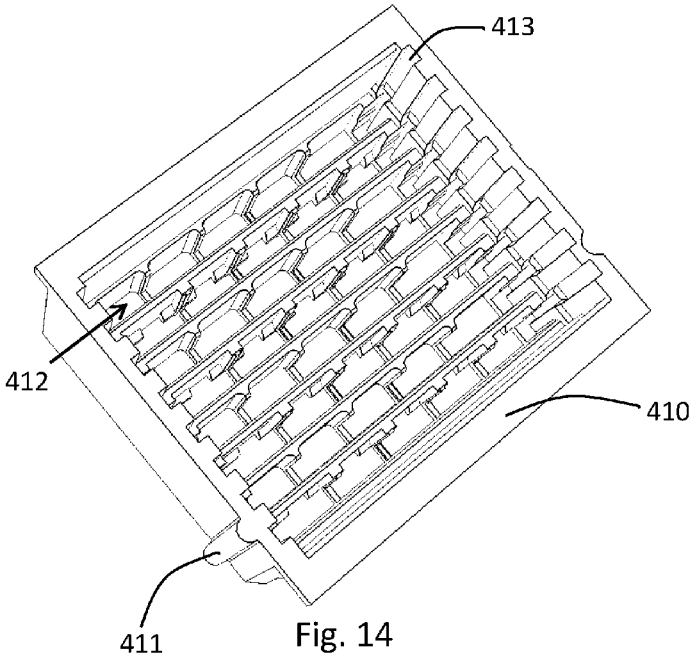
FIG. 14 is a top perspective view of the housing of the connector shown in FIGS. 12 and 13.
Figure 15:
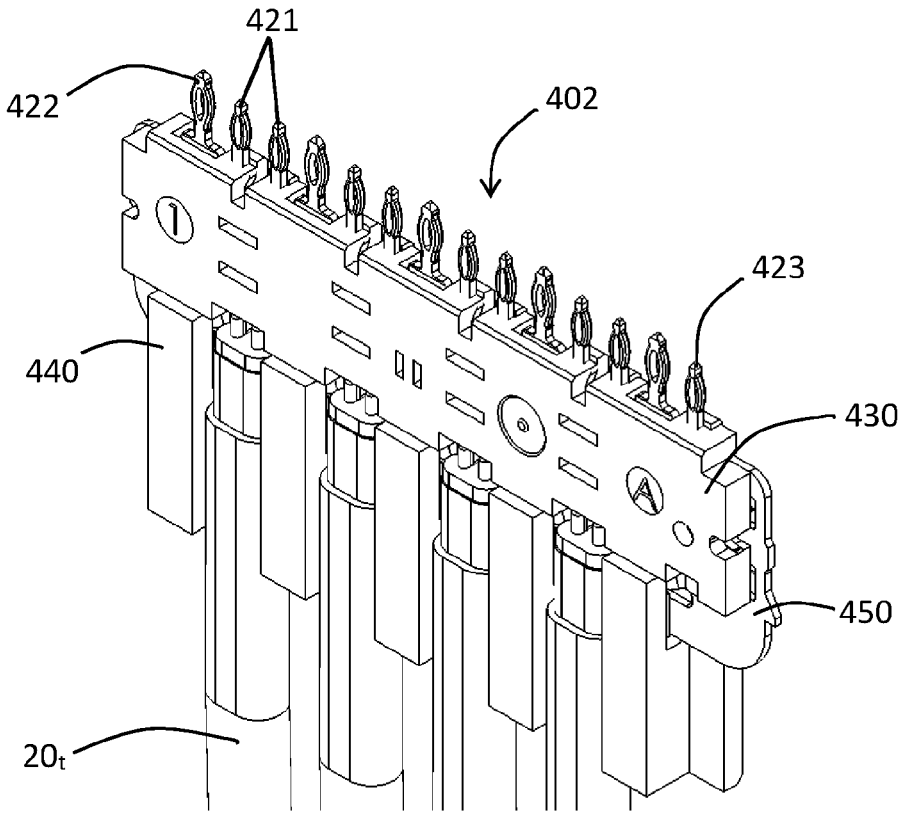
FIG. 15 is a perspective view of a portion of the cable/carrier assembly used with the connector shown in FIGS. 12 and 13.

FIG. 14 is a top perspective view of the housing 410, and FIG. 15 is a perspective view of a portion of the cable/carrier assembly 402 that is inserted into the housing 410. The housing 410 includes slots 412 and grooves 413 that receive the cable/carrier assembly 402. Any number of slots 412 and grooves 413 can be used. The cable/carrier assembly 402 includes a carrier 430, a clip 440, and a ground plate 450. The carrier 430 is connected to the twinaxial cables $\mathbf{20}_t$ and the press-fit contacts 421, 422, 423. Any number of twinaxial cables $\mathbf{20}_t$ can be used. The carrier 430 can be a plastic that is molded around the press-fit contacts 421.

The clip 440 holds the ground plate 450 and includes grooves that receive the twinaxial cables $\mathbf{20}_t$. The grooves of the clip 440 support the twinaxial cables $\mathbf{20}_t$. Any number of grooves can be included in the clip 440. The ground plate includes press-fit contacts 422. The ground plate 450 is attached to the carrier 430 in any suitable manner such that the press-fit contacts 422 are located between pairs of press-fit contacts 421 to provide a ground-signal-signal-ground arrangement of contacts. The ground plate 450 can be made of any suitable conductive material. Although FIG. 15 shows that one ground plate 450 is used with the cable/carrier assembly 402, it is possible to use more than one ground plate 450. For example, a second ground plate could be used on the opposite or same side of the cable/carrier assembly 402 as the ground plate 450 shown in FIG. 15. When the connector 401 is connected to a main PCB, the ground plate 450 can be connected to ground in the main PCB. The cable/carrier assembly 402 is configured such that the press-fit contacts 421, 422, 423 are aligned in a single row.

FIG. 16 is a perspective view of the end of one of the twinaxial cables $\mathbf{20}_t$ shown in FIG. 15. The twinaxial cable $\mathbf{20}_t$ of FIG. 16 is similar to the coaxial cable 20 of FIG. 3, except that the twinaxial cable $\mathbf{20}_t$ includes two center conductors 424 instead of a single center conductor 21. The twinaxial cable $\mathbf{20}_t$ includes an outer insulation 427 that surrounds a ground shield 426 that surrounds a dielectric 425 that surrounds the two center conductors 424. This arrangement of the twinaxial cable $\mathbf{20}_t$ allows differential signals to be transmitted by the twinaxial cable $\mathbf{20}_t$. As shown in FIG. 15, the two center conductors 424 can be directly attached to the press-fit contacts 421. Typically, the center conductors 424 are soldered to the press-fit contacts 421, but the center conductors 424 can be attached to the press-fit contacts in any suitable manner.

Any suitable contact can be used instead of the press-fit contacts 421, 422, 423. For example, pogo pins, mill-max terminals and sockets, and through-hole contacts that are soldered on the bottom of the main PCB could be used instead of press-fit contacts 421, 422, 423.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A connector mountable to a main printed circuit board (PCB), the connector comprising:

at least one carrier;

at least one cable mounted to the at least one carrier;

an interposer that routes signals and ground connections between the at least one cable and the main PCB when the connector is mounted to the main PCB; and an intermediate PCB arranged between the at least one carrier and the interposer; wherein the at least one cable is vertically mounted in the connector such that the at least one cable is perpendicular or substantially perpendicular to a mounting surface of the main PCB.

2. The connector according to claim 1, wherein the at least one cable is soldered to the at least one carrier.

3. The connector according to claim 1, wherein the at least one cable is a coaxial cable.

4. The connector according to claim 1, wherein the at least one cable is a twinaxial cable.

5. The connector according to claim 1, wherein the at least one cable is a discrete, unshielded wire.

6. The connector according to claim 1, wherein the at least one cable includes a plurality of cables mounted to a first carrier of the at least one carrier.

7. The connector according to claim 1, wherein:

the at least one cable includes a first cable mounted to a first carrier of the at least one carrier and includes a second cable mounted to a second carrier of the at least one carrier; and the first cable and the second cable include different size center conductors or different characteristic impedances.

8. The connector according to claim 1, wherein a signal path of the at least one cable is connected to a signal path of the intermediate PCB.

9. The connector according to claim 1, wherein the at least one carrier is electrically connected to a ground path via or a ground region of the intermediate PCB.

10. The connector according to claim 1, wherein a ground path or ground shield of the at least one cable is connected to the at least one carrier.

11. The connector according to claim 1, wherein the at least one carrier includes prongs that are aligned with a signal conductor of the at least one cable along a length of the at least one carrier such that the prongs of the at least one carrier and the signal conductor of the at least one cable define a single row.

12. The connector according to claim 1, wherein the at least one carrier includes tabs that are offset from a signal conductor of the at least one cable.

13. The connector according to claim 1, wherein the interposer includes at least one guide hole arranged to mate with at least one alignment pin of the main PCB to align at least one contact of the interposer with at least one contact of the main PCB.

14. The connector according to claim 1, wherein the interposer includes compression contacts on at least one surface.

15. The connector according to claim 1, wherein the interposer includes solderable contacts on at least one surface.

16. The connector according to claim 1, further comprising a housing; wherein the at least one carrier, a portion of the at least one cable, and the interposer are inside of the housing.

17. The connector according to claim 16, wherein:

the at least one carrier includes at least one carrier hole;

the housing includes at least one lateral housing hole;

the at least one carrier hole is arranged to align with the at least one lateral housing hole; and a rod extends into each of the at least one lateral housing hole and through the at least one carrier hole to mechanically secure the at least one carrier to the housing.

18. The connector according to claim 16, wherein:

the housing includes at least one vertical housing hole arranged to receive a guide mounted to the main PCB; and the connector is secured to the main PCB by a fastener.

19. The connector according to claim 18, wherein the fastener is a threaded screw.

20. A connector mountable to a main printed circuit board (PCB), the connector comprising:

at least one carrier;

at least one cable mounted to the at least one carrier; and an interposer that routes signals and ground connections between the at least one cable and the main PCB when the connector is mounted to the main PCB; wherein a center conductor of the at least one cable is directly connected to the interposer; and the at least one cable is vertically mounted in the connector such that the at least one cable is perpendicular or substantially perpendicular to a mounting surface of the main PCB.

21. The connector according to claim 20, wherein the at least one cable includes a plurality of cables mounted to a first carrier of the at least one carrier.

22. The connector according to claim 20, wherein:

the at least one cable includes a first cable mounted to a first carrier of the at least one carrier and includes a second cable mounted to a second carrier of the at least one carrier.

23. The connector according to claim 20, wherein the interposer includes compression contacts on at least one surface.

24. The connector according to claim 21, wherein the interposer includes solderable contacts on a surface to be mounted to the main PCB.

* * * * *